US007664650B2

(12) United States Patent
Endo et al.

(10) Patent No.: US 7,664,650 B2
(45) Date of Patent: Feb. 16, 2010

(54) SPEECH SPEED CONVERTING DEVICE AND SPEECH SPEED CONVERTING METHOD

(75) Inventors: Kaori Endo, Kawasaki (JP); Yasuji Ota, Kawasaki (JP); Taro Togawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 456 days.

(21) Appl. No.: 11/233,192

(22) Filed: Sep. 22, 2005

(65) Prior Publication Data

US 2006/0293883 A1 Dec. 28, 2006

(30) Foreign Application Priority Data

Jun. 22, 2005 (JP) ..... 2005-181843

(51) Int. Cl.
*G10L 21/00* (2006.01)
*G10L 19/14* (2006.01)

(52) U.S. Cl. ..... 704/278; 704/219; 704/211

(58) Field of Classification Search ..... 704/208, 704/214, 207, 211, 219, 278
See application file for complete search history.

(56) References Cited

U.S. PATENT DOCUMENTS 5,305,420 A 4/1994 Nakamura et al.
5,809,454 A * 9/1998 Okada et al. ..... 704/214
5,933,802 A * 8/1999 Emori ..... 704/219
5,995,925 A 11/1999 Emori
7,275,030 B2 * 9/2007 Navratil et al. ..... 704/207
7,363,232 B2 * 4/2008 Megeid et al. ..... 704/503

FOREIGN PATENT DOCUMENTS

JP 01093795 4/1989
JP 09062300 3/1997
JP 11311997 11/1999

* cited by examiner

*Primary Examiner*—Angela A Armstrong
(74) *Attorney, Agent, or Firm*—Fujitsu Patent Center

(57) ABSTRACT

The invention relates to speech speed conversion, and provides a speech speed converting device and a speech speed converting method for changing a speed of voice without degrading the voice quality, without changing characteristics, regarding a signal containing voice. The speech speed converting device includes: a voice classifying unit that is input with voice waveform data and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method.

8 Claims, 13 Drawing Sheets

SPEECH SPEED CONVERTING DEVICE AND SPEECH SPEED CONVERTING METHOD

BACKGROUND OF THE INVENTION

1. Field of the Invention

The present invention relates to speech speed conversion. Particularly, the invention relates to a speech speed converting device and a speech speed converting method for changing a voice speed without degrading the voice quality and without changing characteristics, regarding a signal containing voice.

2. Description of the Related Art

A speech speed converting device is used in a telephone system or a voice reproducing system. By changing the speed of the voice at the time of reproducing a received voice or a recorded voice, a user can listen to the received content or the recorded content at a speed convenient for the user. For example, when a person at the other end of the line speaks quickly and a person who receives the call cannot easily understand the voice, the speed of the speech is decreased in real time or at the reproduction time. With this arrangement, the listener can understand the speech content easily. On the other hand, by increasing the speed of the voice at the reproduction time, the recorded content can be heard in a time shorter than the actual recording time.

FIG. 1 shows one example of a speech speed converting device that is applied to a voice communication system such as a telephone.

In FIG. 1, a receiving unit 10 of the telephone receives a voice code via a digital line or the like. A decoding unit 11 decodes the voice code into a voice waveform signal. A speech speed converting unit 12 including a speech speed converting device converts the voice waveform signal into a voice waveform signal of a slower speed, for example. An output unit 13 such as a receiver outputs the received voice to the outside. While the decoding unit 11 restores the voice code into the voice waveform, in the present example, the speech speed converting unit 12 can directly convert the speed of the voice code received by the receiving unit 10, decode the speed-converted voice code, and input the decoded voice to the output unit 13.

As a method of converting the speech speed, a time-domain harmonic scaling (TDHS) is widely known. According to the TDHS, a waveform of voice of which speed is to be changed is repeated in a basic frequency or is thinned, thereby adjusting the speed. There are also improved methods of repeating or thinning the waveform to convert the speech speed. One example is that voice is classified into several kinds, and a speed converting method is switched over between classified voices.

FIG. 2 shows one example of a configuration of a conventional speech speed converting device using a voice waveform.

In the present example, a voice classifying unit 20 classifies an input voice waveform into "voiced sound" and "unvoiced sound". When the input voice waveform is "voiced sound", a pitch cycle calculating unit 21 calculates a pitch cycle of the "voiced sound". A voice speed converting unit 22 adjusts the speed of the voice by repeating or thinning the "voiced sound" waveform input based on the pitch cycle calculated by the voice speed converting unit 22.

According to the following patent literature 1, voice is classified into "vowel sound", "voiced consonant", "unvoiced consonant", and "silence". The speed of the "vowel sound" and the "voiced consonant" is converted by repeating or thinning the voice waveform in a pitch cycle. The "unvoiced consonant" is not expanded or contracted according to the characteristic of the consonant, or the speed is converted by repeating or deleting the waveform to have a predetermined length. On the other hand, the speed of the "silence" is converted by repeating or deleting the waveform to have a predetermined length.

According to the following patent literature 2, voice is classified into "voiced sound", "unvoiced sound", and "silence". The speed of the "voiced sound" is converted by repeating or thinning the voice waveform in a pitch cycle. The "unvoiced sound" is not processed, and the speed of the "silence" is converted by expanding or contracting the waveform at a predetermined magnification.

According to the following patent literature 3, voice is classified into "voiced sound", "unvoiced sound", and "silence". The speed of the "voiced sound" is converted by repeating or thinning the voice waveform in a pitch cycle. The speed of the "unvoiced sound" is converted by repeating or thinning the voice waveform in a fixed cycle (i.e., a pseudo pitch). The speed of the "silence" is converted by repeating or thinning the waveform following a predetermined expansion and contraction rate.

FIG. 3 shows one example of a configuration of a conventional speech speed converting device using a voice code.

In the present example, a residual signal and a linear predictive coefficient of an input voice are obtained in advance based on a linear predictive analysis of the input voice. A pitch cycle calculating unit 30 calculates a pitch cycle of an input signal using the residual signal. A voice production speed converting unit 31 outputs a residual signal that is repeated or thinned based on the calculated pitch cycle, thereby converting the speed, and gives the speed conversion information to a linear predictive coefficient correcting unit 32.

The linear predictive coefficient correcting unit 32 corrects and outputs a linear predictive coefficient corresponding to the residual signal that is repeated or thinned based on the speed conversion information. A combining unit 33 filters the residual signal input from the voice production speed converting unit 31 using the linear predictive coefficient given from the linear predictive coefficient correcting unit 32, and outputs the speed-converted voice waveform.

The following patent literature 4 describes a method of carrying out a linear predictive analysis to separate the input voice into a linear predictive coefficient and a predictive residual signal, and preventing degradation in the pitch analysis due to a pitch extraction error by repeating or thinning the predictive residual signal having a strong pitch in a pitch cycle. When the linear predictive analysis is used, with a view to improving precision of the pitch analysis, the pitch is extracted using the predictive residual in which pitch appears more strongly than a voice waveform. The predictive residual is repeated or thinned in the extracted pitch cycle.

The following patent literature 5 describes a method of converting the speed by extending a multi-path sound source by filling "0" using a voice code, or by shortening the sound source by cutting "0".

(Patent literature 1) Japanese Patent Publication No. 2612868

(Patent literature 2) Japanese Patent Publication No. 3327936

(Patent literature 3) Japanese Patent Publication No. 3439307

(Patent literature 4) Japanese Patent Application Unexamined Publication No. 11-311997

(Patent literature 5) Japanese Patent Publication No. 3285472

However, the above conventional techniques have the following problems.

(1) Problems that arise when the speed is converted using the voice waveform

According to the patent literature 1, in the "unvoiced consonant", waveforms of sections other than those discriminated as "liquid sound", "plosive and affrictive sound", and "burst" are repeated or thinned. Therefore, there is a problem that cyclicity that is not originally present appears due to the repetition or thinning of the waveform, and the voice quality is degraded.

According to the patent literature 2, the "unvoiced sound" is not processed. Therefore, there is a problem that when the "unvoiced sound" is expanded or contracted, the balance of the length with that of other sections is destroyed, and the voice quality is degraded. In this case, a section that can be expanded or contracted becomes small, and a large expansion or contraction cannot be achieved. According to the patent literature 3, because the "unvoiced sound" is thinned or repeated in a fixed cycle (i.e., a pseudo pitch), there is a problem that cyclicity that is not originally present appears, and the voice quality is degraded.

(2) Problems that arise when the speed is converted using the voice code such as a linear predictive analysis According to the patent literature 4, there is a problem that, in the unvoiced section in which a pitch cycle is not particularly present, a repetition or a thinning is carried out in an extremely long or short section in an indefinite pitch (i.e., a variation in an extremely large or small pitch value). As a result, a mismatch occurs between a linear predictive coding (LPC) coefficient and the predictive residual, in the section where the LPC coefficient changes, thereby degrading the voice quality.

According to the patent literature 5, a multi-path sound source is extended by filling "0" using a voice code, or is shortened by cutting "0". There is also a problem that the speed cannot be adjusted in the unvoiced section where there is no pitch. Therefore, the balance of the length with that of other section that is expanded or contracted is destroyed, and the voice quality is degraded. When "0" is filled, an expandable or contractible section decreases. Consequently, a large expansion or contraction cannot be achieved.

SUMMARY OF THE INVENTION

In the light of the above problems, it is an object of the present invention to provide a speech speed converting device and a speech speed converting method for adjusting the speed of a speech without degrading the voice quality, by suitably switching between a speed adjusting method using both voice waveform data and a voice code obtained based on a linear prediction and a speed adjusting method using one of the voice waveform data and the voice code, according to the characteristic of an input voice.

According to one aspect of the present invention, there is provided a speech speed converting device that adjusts a speech speed using both voice waveform data and a voice code based on a linear prediction.

According to another aspect of the invention, there is provided a speech speed converting device including: a voice classifying unit that is input with voice waveform data and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method. The speed conversion processing includes an adjustment of a speed conversion level based on the classification.

According to still another aspect of the invention, there is provided a speech speed converting method for adjusting a speech speed using both voice waveform data and a voice code based on a linear prediction.

According to another aspect of the invention, there is provided a speech speed converting method including the steps of: inputting voice waveform data and a voice code based on a linear prediction, and classifying the input signal based on the characteristic of the input signal; selecting either one of or both a speed conversion processing using the voice waveform and a speed conversion processing using the voice code, based on the classification; and changing a speech speed of the input signal using the selected speed converting method. The speed conversion processing includes an adjustment of a speed conversion level based on the classification.

According to the present invention, because both the voice waveform data and the voice code are used, either one of or both of voice waveform data and the voice code can be selectively used based on the characteristic of the voice. As a result, the quality of the speed-converted voice is improved remarkably, as compared with the quality of voice obtained by the conventional practice of using only one of the voice waveform data and the voice code.

According to the present invention, the input signal is classified in detail corresponding to the characteristic of the input signal. A method of adjusting a speech speed is suitably selected from a method using one of the voice waveform data and the voice code and a method using both the voice waveform data and the voice code, according to the classification, thereby generating no degradation of the voice quality. As a result, the quality of the speed-converted voice is improved remarkably, as compared with the quality of voice obtained by the conventional practice of using only one of the voice waveform data and the voice code. As described later, the speed of a "cyclical" section is suitably converted using a voice waveform. When a "non-cyclical and steady" section has a discontinuous section due to a repetition or a deletion of residuals, this discontinuity can be alleviated by passing this section through a linear prediction filter. The speed of the "non-cyclical and steady" section is suitably converted using a voice code.

According to the present invention, when both the voice waveform data and the voice code are used simultaneously, and when weighted speed adjustments are combined together, a speech speed can be adjusted by further decreasing the degradation of the voice.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 4:
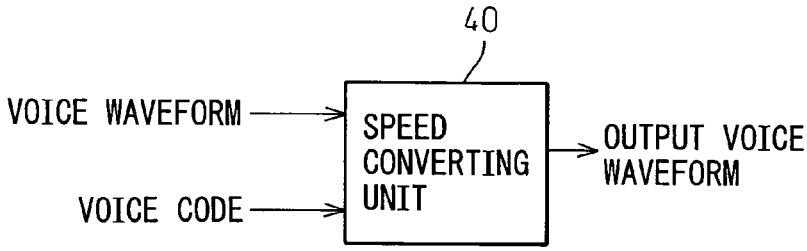
FIG. 4 is an explanatory diagram showing a basic configuration of a speech speed converting device according to the present invention.

FIG. 4 is an explanatory diagram showing a basic configuration of a speech speed converting device according to the present invention.

In FIG. 4, a voice waveform and a voice code are input to a speed converting unit 40. The speed converting unit 40 adjusts a speech speed using either one of or both the voice waveform and the voice code according to the characteristic of the voice, and outputs speed-adjusted voice.

Figure 5:
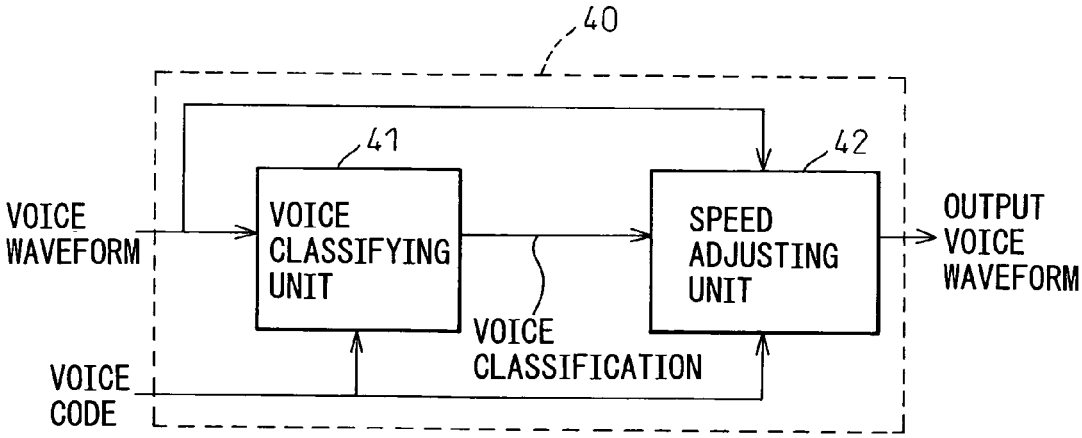
FIG. 5 is an explanatory diagram showing an example of a configuration of a speed converting unit shown in FIG. 4.

FIG. 5 is an explanatory diagram showing an example of a configuration of the speed converting unit 40 shown in FIG. 4.

In FIG. 5, a voice classifying unit 41 classifies an input voice according to the characteristic of the voice. A speed adjusting unit 42 suitably selects between a speed adjusting method using both a voice waveform and a voice code and a speech adjusting method using one of a voice waveform and a voice code, according to a result of classifying the voice. The speed adjusting unit 42 adjusts the speed using the selected method, and outputs the speed-adjusted voice. The voice classifying unit 41 is mounted with a central processing unit (CPU) and a digital signal processor (DSP), and consists of a normal CPU circuit including a read-only memory (ROM), a random access memory (RAM), and an input/output (I/O) peripheral device. The speed adjusting unit 42 also has a similar configuration, as shown in the following block configuration diagram.

Figure 6:
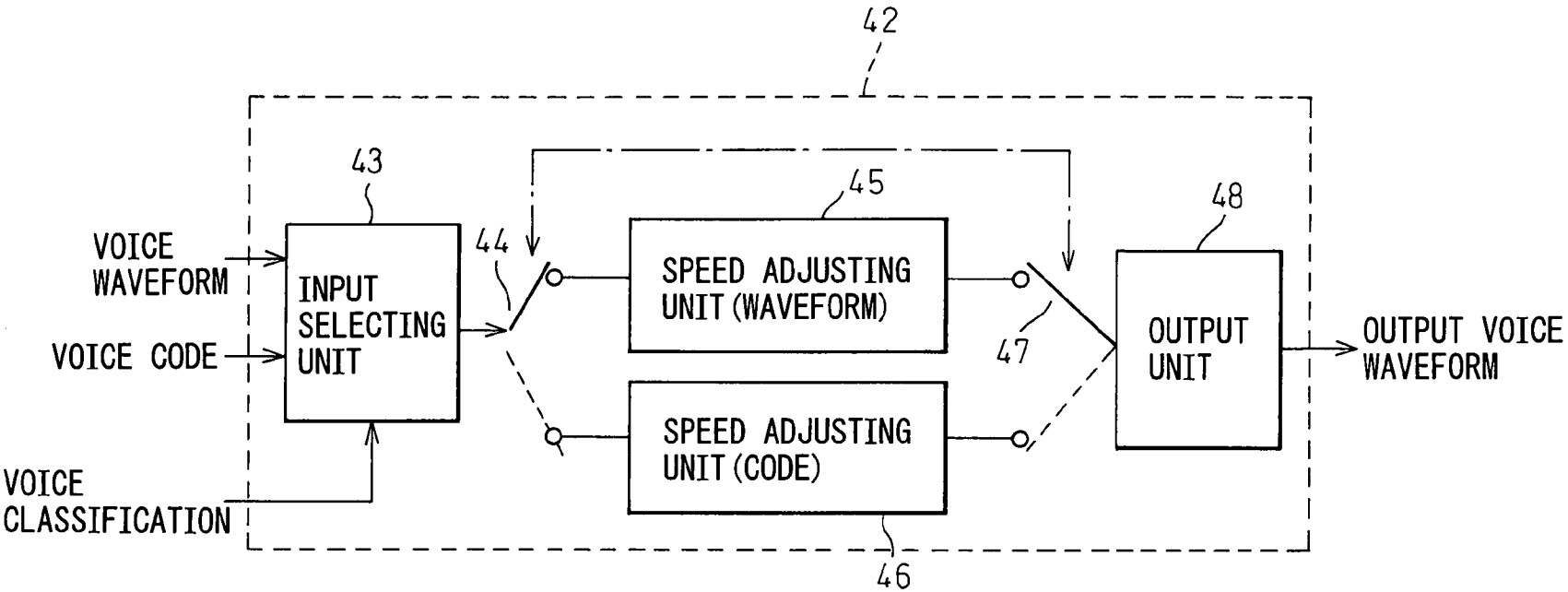
FIG. 6 is an explanatory diagram showing an example of a configuration of a speed adjusting unit shown in FIG. 5.
Figure 7:
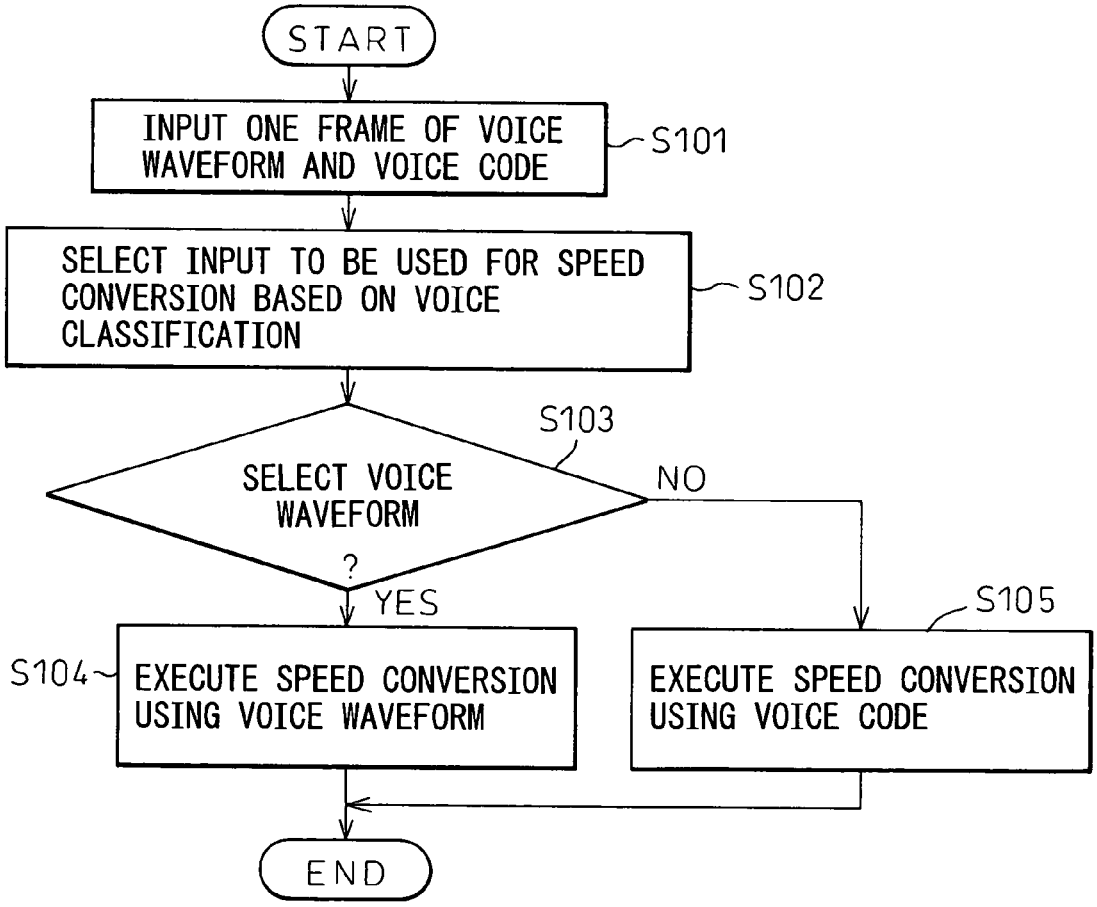
FIG. 7 is a flowchart showing one example of a processing flow.

FIG. 6 is an explanatory diagram showing an example of a configuration of the speed adjusting unit 42 shown in FIG. 5. FIG. 7 is a flowchart showing one example of a processing flow.

In the present example, a speech speed is adjusted using one of voice waveform data and a voice code obtained by a linear prediction operation. An input selecting unit 43 selects one of the voice waveform and the voice code for input one frame, based on a voice classification from the voice classifying unit 41 (at steps S101 and S102).

Similarly, latter-stage interlocked switches 44 and 47 are switched over to a voice waveform speed adjusting unit 45 or a voice code speed adjusting unit 46 based on a voice classification (at step S103). The speed adjusting unit 45 or the speed adjusting unit 46 to which the interlocked switches 44 and 47 are switched over by the input selecting unit 43 executes a speed adjustment processing using the corresponding voice waveform or the corresponding voice code (at step S104 or S105), and outputs a speed-adjusted voice waveform to an output unit 48.

Because a voice waveform or a voice code to be used for a speed adjustment is suitably selected based on the voice classification, degradation in the voice after the speed conversion is remarkably decreased as compared with when the speed is converted using only the voice waveform or the voice code.

Figure 8:
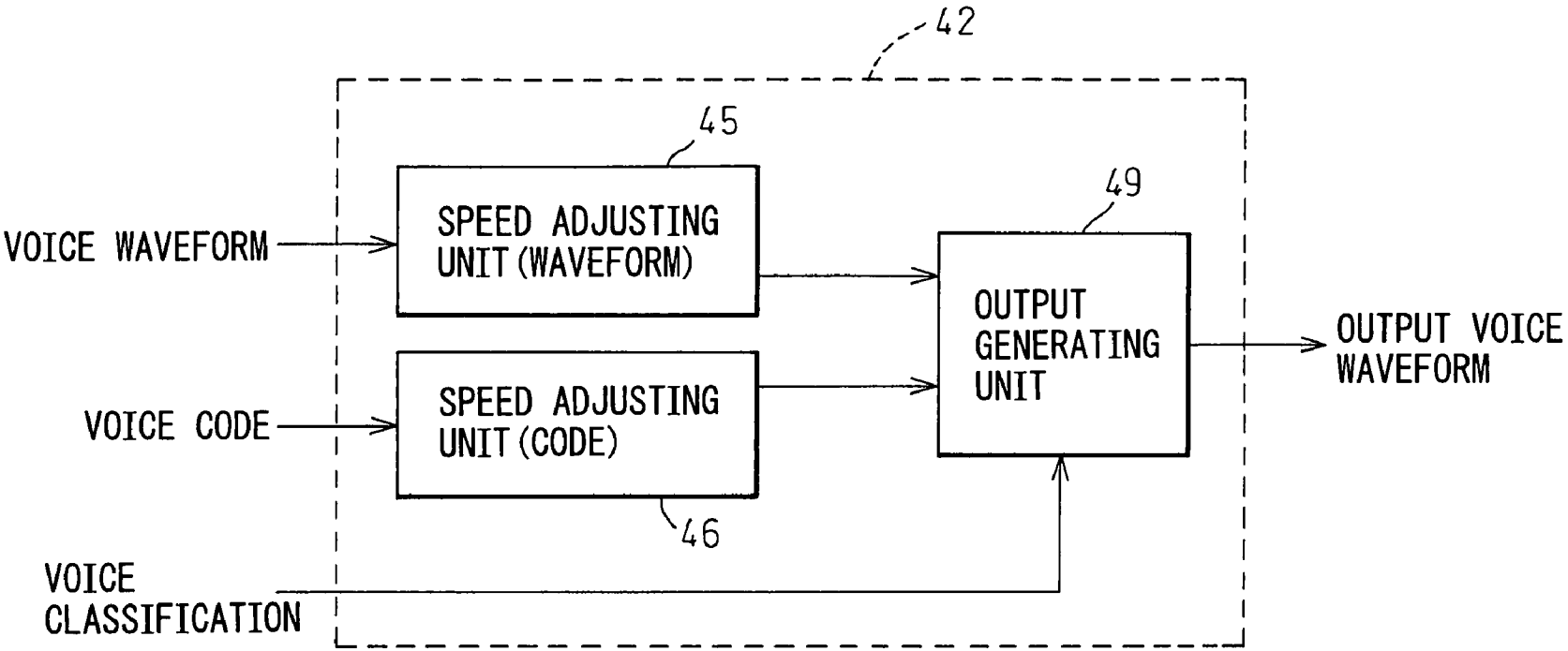
FIG. 8 is an explanatory diagram showing another example of a configuration of the speed adjusting unit shown in FIG. 5.
Figure 9:
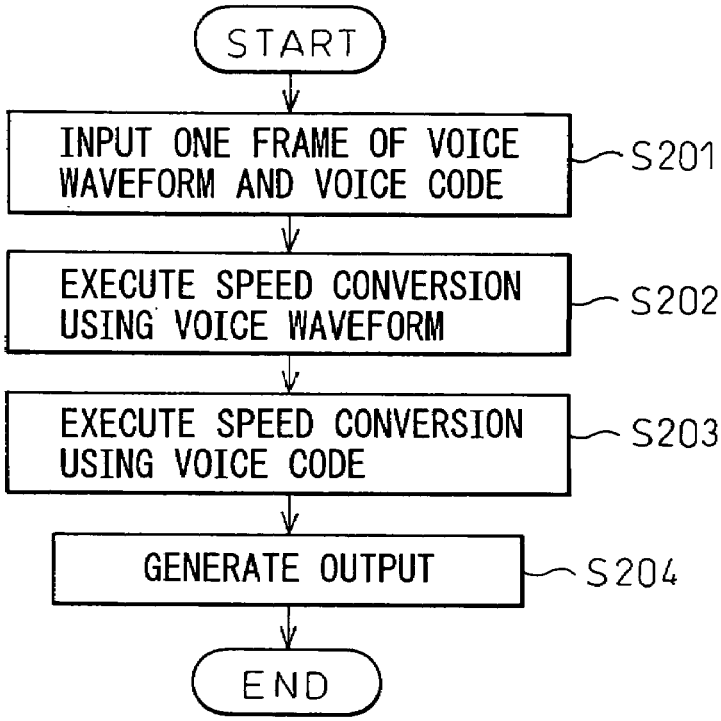
FIG. 9 is a flowchart showing an example (1) of a processing flow shown in FIG. 8.
Figure 10:
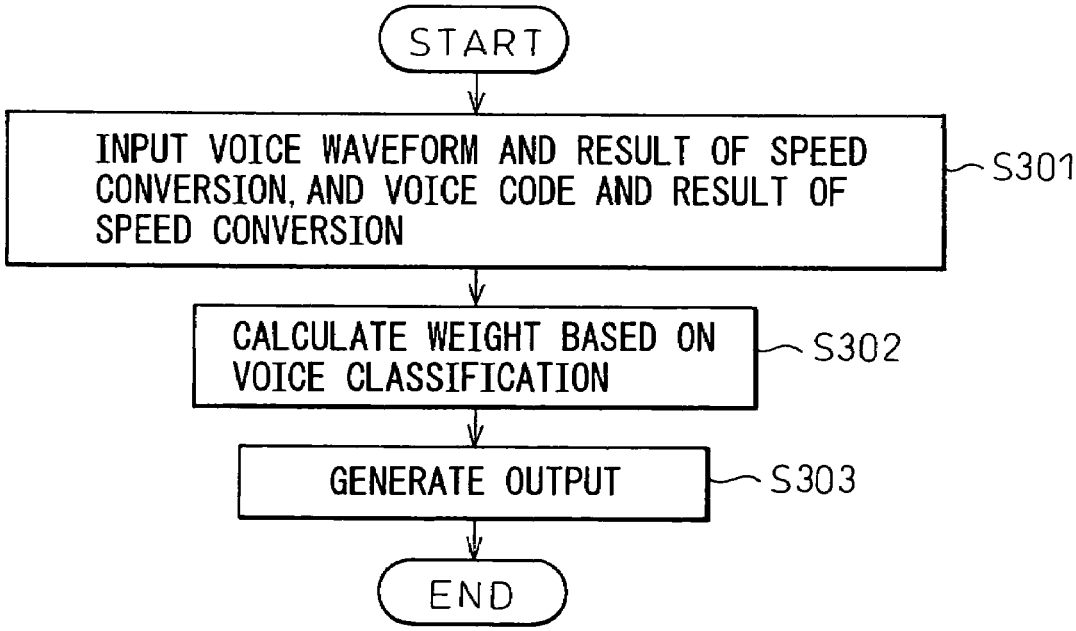
FIG. 10 is a flowchart showing an example (2) of the processing flow shown in FIG. 8.

FIG. 8 is an explanatory diagram showing another example of a configuration of the speed adjusting unit 42 shown in FIG. 5. FIG. 9 and FIG. 10 are flowcharts of examples of the processing flow shown in FIG. 8.

In the present example, a speech speed is adjusted by simultaneously using both voice waveform data and a voice code obtained by a linear prediction operation. Therefore, the input selecting unit 43 shown in FIG. 7 is not necessary. The voice waveform and the voice code that are input are directly applied to the speed adjusting unit 45 and the speed adjusting unit 46 respectively. A voice waveform obtained by speed-converting the voice waveform by the speed adjusting unit 45 and a voice waveform obtained by speed-converting the voice code by the speed adjusting unit 46 are input to the next-stage output generating unit 49 (at steps S201 to S204).

The output generating unit 49 calculates weights of the two input voice waveforms based on the voice classification from the voice classifying unit 41 (at steps S301 and S302), adds the weighted two voice waveforms together, and outputs the added result (at step S303). As an example of the application of this method, a switching over from a speed adjusting section using a voice waveform to a speed adjusting section using a voice code is considered.

In this case, first, a weight "1" is given to the voice waveform input from the speed adjusting unit 45 that uses the voice waveform, and a weight "0" is given to the waveform output from the speed adjusting unit 46 that uses the voice code. Then, within a predetermined section switching time, the weight of the voice waveform from the speed converting unit 45 is gradually decreased from "1" to "0". On the other hand, the weight of the voice waveform from the speed adjusting unit 46 is gradually increased from "0" to "1". The weight can be changed linearly or exponentially. As a result, in the present example, noise attributable to the discontinuity of the waveform generated at the time of switching over between the voice waveform section and the voice code section can be substantially restricted.

Figure 11:
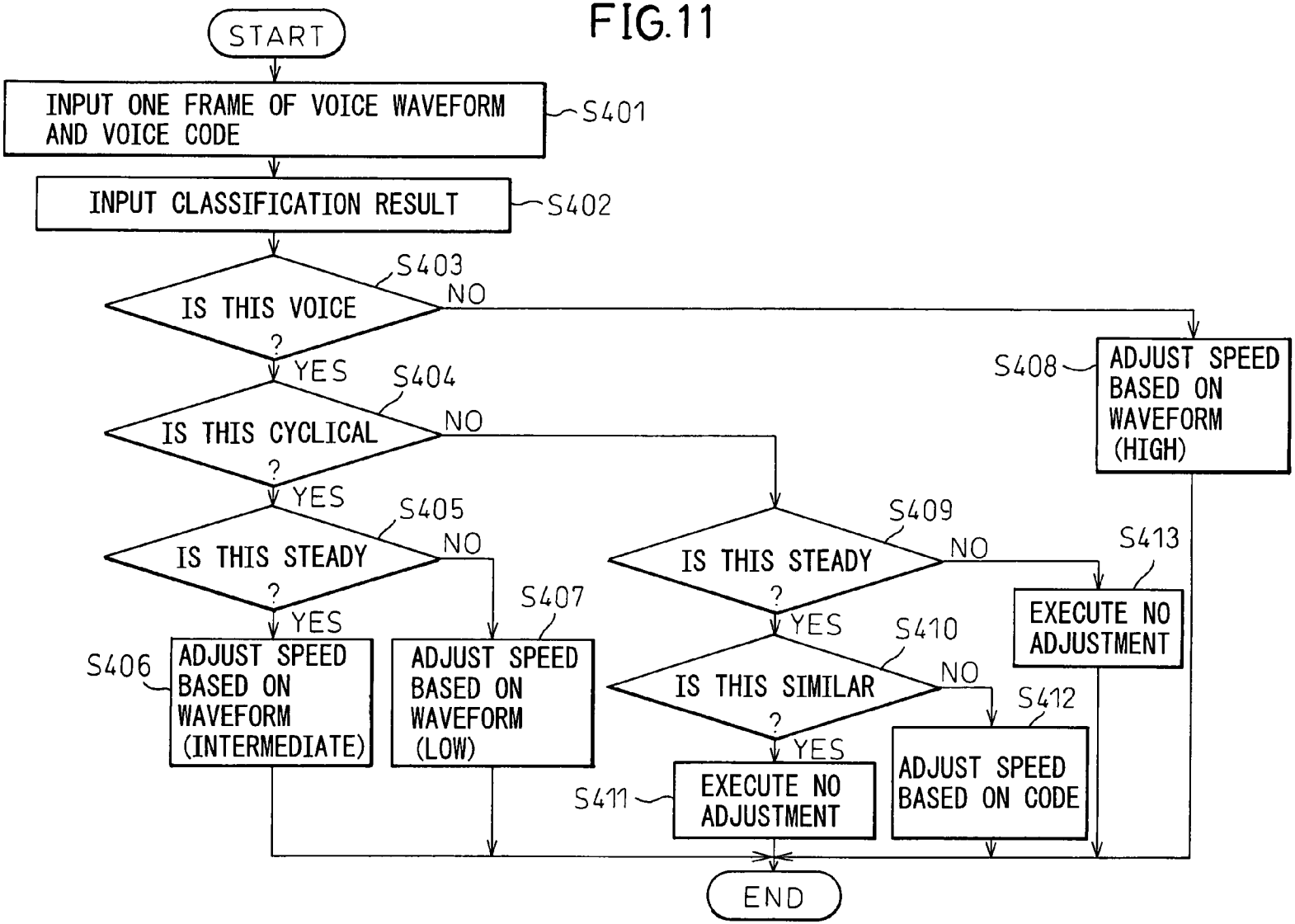
FIG. 11 is an explanatory diagram of a processing flow according to one embodiment of the present invention.

FIG. 11 is an explanatory diagram of a processing flow according to one embodiment of the present invention. The operation is explained using a flow of the operation carried out by the voice classifying unit 41 and the speed adjusting unit 42 shown in FIG. 5.

In the present example, the voice classifying unit 41 first classifies voice into voice and nonvoice based on whether a frame contains voice (at steps S401 to S403). For example, when short-time power of an input signal continues for a predetermined time or more, the voice classifying unit 41 decides that the frame contains voice. Next, a section decided as voice is classified in further detail. In the present example, voiced sound is classified as "cyclical", and unvoiced sound such as surrounding noise is classified as "noncyclical" (at step S404). The voiced sound is further classified into "cyclical and steady" and "cyclical and unsteady" by taking into account a level variation (at step S405).

The unvoiced sound is further classified into "noncyclical, steady, and similar" and "noncyclical, steady, and dissimilar" by taking into account a level variation and burst (at steps S409 and S410). Further, the unvoiced sound is classified into "noncyclical and unsteady" by taking into account a plosive and the like (at step S413). A classification similar to the above can be also applied to a section decided as nonvoice.

The speed adjusting unit 42 selects a speed adjusting method suitable for each classification based on the above result of classification, and switches the method to the selected speed adjusting method. In the present example, the speed of the section classified as "cyclical and steady" out of the sections decided as voice is adjusted using a voice waveform. The speed is adjusted to an intermediate adjustment level (at step S406). On the other hand, the speed of the section classified as "cyclical and unsteady" out of the sections decided as voice is adjusted using a voice waveform. The speed is adjusted to a low adjustment level (at step S406).

The speed of the section classified as "noncyclical" out of the sections decided as voice is adjusted using a voice code. However, the speed of the section classified as "noncyclical, steady, and similar" and "noncyclical and unsteady" is not adjusted. The speed of the section decided as nonvoice is adjusted using a waveform. The speed is adjusted to a high adjustment level.

As used herein, the terms "low adjustment level", "intermediate adjustment level" and "high adjustment level" indicate a relative magnitude relation between adjustment levels. The above adjustment levels correspond to the classifications for the signal sections, respectively, and an adjustment level for a signal section is determined based on the classification decided for the signal section, in accordance with the following relative magnitude relation: "Cyclical and Unsteady (low adjustment level)"<"Cyclical and Steady (intermediate adjustment level)"<"Nonvoice (high adjustment level)".

When the voice classifying unit 41 classifies voice in detail using "cyclicity", "steadiness", and "similarity", the speed adjusting unit 42 in the present example converts the speed using a voice waveform in the "cyclical" section (after "yes" at step S404) according to the classification. The voice classifying unit 41 converts the speed using a voice code in the "noncyclical" section (after "no" at step S408) except when the speed conversion is not carried out (at steps S411 and S413).

In the cyclical section, the speed can be converted without substantially degrading the voice quality by repeating or deleting a voice waveform according to the cycle. However, when a voice code is used in the cyclical section, a repetition or a deletion of a residual signal of the input voice affects a state after the linear prediction filter, and a mismatch occurs between the predictive coefficient and the residual signal. Therefore, the speed is converted using a voice waveform in the cyclical section.

On the other hand, the speed is converted using a voice code in the noncyclical section for the following reason. In the "noncyclical and steady" section (after "yes" at step S409), when the speed is adjusted using a voice waveform, the waveform becomes discontinuous due to a repetition or a deletion of the waveform. Further, cyclicity that is not originally present appears, and voice is degraded. When a voice code is used in this section, even when discontinuity occurs due to a repetition or a deletion of a residual, this discontinuity is alleviated by finally passing the voice through the linear prediction filter. The "steady" section has little change in the frequency characteristic excluding rising and declining sections of the filter. Therefore, there is little influence to the state of the linear predicting filter due to a repetition or a deletion of the residual, and sound is not easily degraded.

A level of speed adjustment carried out by the speed adjusting unit 42 is determined for the following reason.

In the "nonvoice" section (at step S408), the speed adjusting unit 42 searches for a part of the voice waveform in which both ends of nonvoice sections are smoothly connected without discontinuity, both at the time of increasing the speed and at the time of decreasing the speed. The speed adjusting unit 42 deletes all the section sandwiched by these nonvoice sections. In this case, a speed adjustment level becomes "high".

In the "cyclical and steady" section (at step S406), the speed adjusting unit 42 adjusts the speed without degrading voice by repeating or thinning using a voice waveform in the cyclical and steady section of the voice signal. In this case, when the number of times of carrying out a repetitions or a thinning becomes extremely large, artificiality occurs. Therefore, a speed adjustment level is set to "intermediate". The "cyclical and unsteady" section (at step S407) has cyclicity like a level variation of a voice signal, but has a change in power. Therefore, the speed adjusting unit 42 sets a speed adjustment level to "low" to decrease degradation in voice due to a power change, at the time of cyclically repeating or thinning using a voice waveform.

The "noncyclical, steady, and dissimilar" section (at step S112) is a section where a signal having no correlation continues steadily. The speed adjusting unit 42 adjusts the speed using a voice code in this section. In this case, the speed can be adjusted (i.e., the speed can be decreased) without generating new cyclicity, by generating a fixed codebook at random. Further, discontinuity can be restricted by generating an output signal using a linear prediction filter after contracting (deleting) a residual signal.

On the other hand, the "noncyclical, steady, and similar" section (at step S111) and the "noncyclical and unsteady" section (at step S113) are sections where a signal change is large, and voice is easily degraded due to a speed adjustment. Therefore, the speed adjusting unit 42 does not adjust the speed of this section. According to the present invention, the voice classifying unit 41 classifies the input voice, and the speed converting unit 42 selectively uses a speed converting method. Consequently, a proportion of the expansion and contraction section of the voice, without degrading the voice, can be increased.

Detailed processing contents of the above embodiment are explained below.

Figure 12:
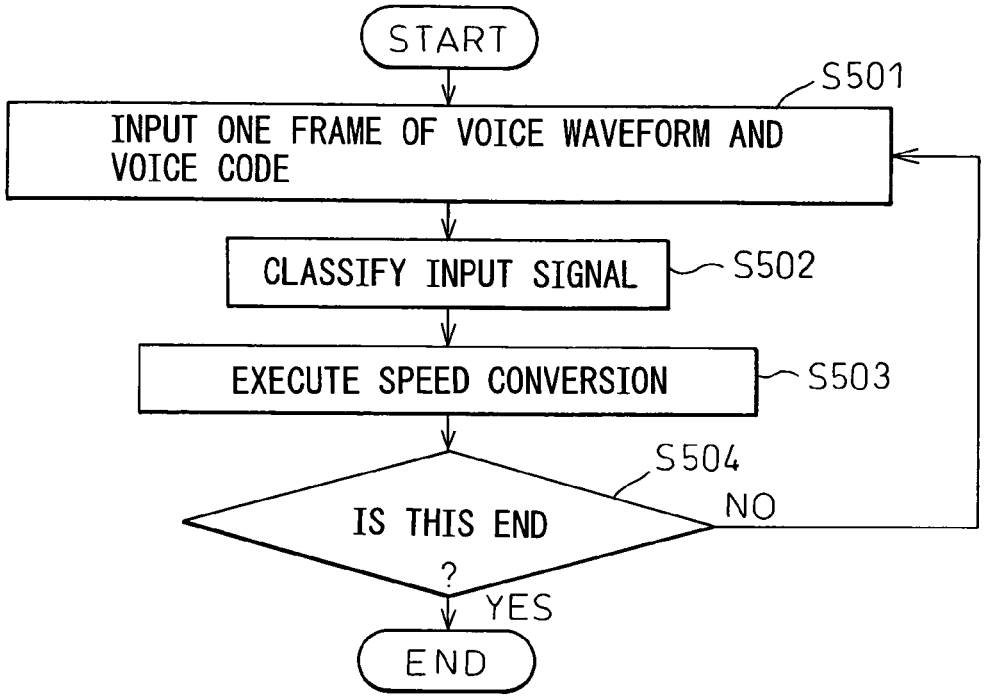
FIG. 12 is a flowchart showing a basic flow of the processing shown in FIG. 11.

FIG. 12 is a flowchart showing a basic flow of the processing shown in FIG. 11.

In FIG. 12, the speed converting unit 40 shown in FIG. 4 (i.e., the voice classifying unit 41 and the speed adjusting unit 42 shown in FIG. 5) first inputs one frame of an input signal (i.e., a voice waveform and a voice code obtained by executing a linear predictive conversion of the voice waveform) (at step S501). The voice classifying unit 41 classifies the input signal shown in FIG. 11 (at step S502), and the speed adjusting unit 42 executes the speed conversion processing shown in FIG. 11 based on this classification (at step S503). The speed converting unit 40 continues the above processing until when a series of input frame ends (at step S504).

Figure 13:
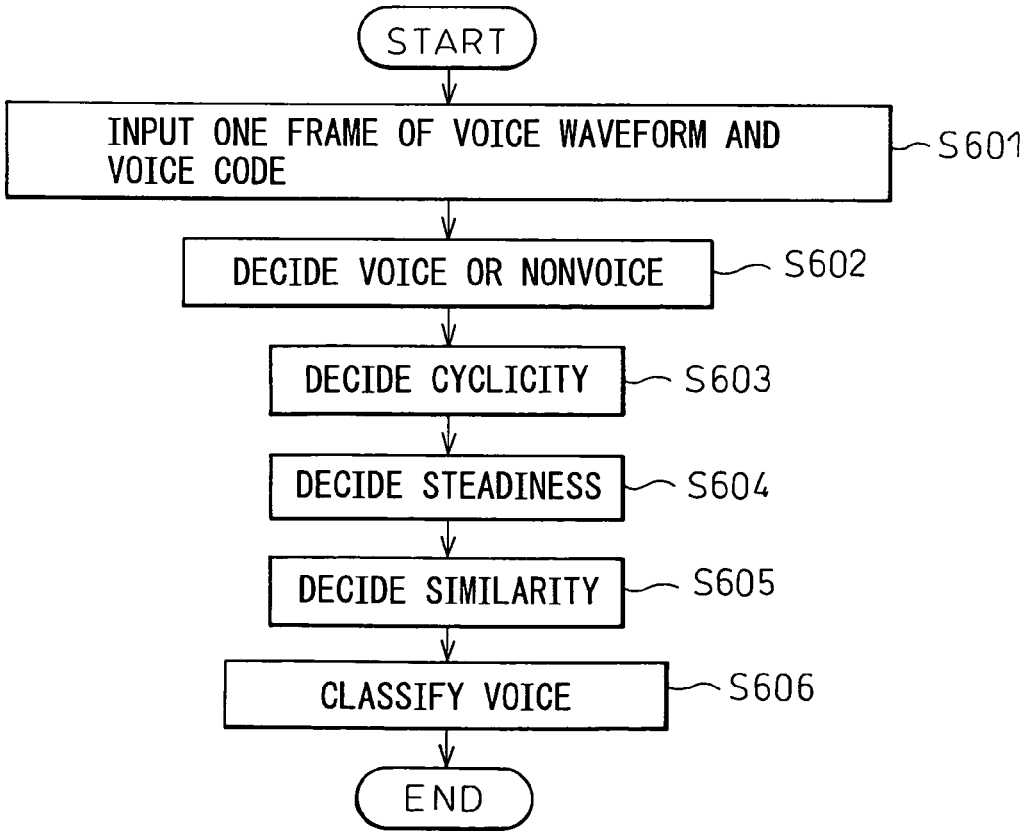
FIG. 13 is a flowchart showing one example of a flow of a classification processing of an input signal carried out by a voice classifying unit.

FIG. 13 is a flowchart showing one example of a flow of the classification processing of the input signal carried out by the voice classifying unit 41 (at step S502 in FIG. 12).

In the present example, input signals are classified based on a decision about voice and nonvoice, and a decision about presence or absence of cyclicity, presence or absence of steadiness, and presence or absence of similarity. First, an input signal is broadly classified into a "voice" section and a "nonvoice" section. A section decided as "voice" is further classified into a "cyclical" section, a "noncyclical and steady" section, and a "noncyclical and unsteady" section (see FIG. 11).

Therefore, the voice classifying unit 41 inputs one frame of a voice waveform and a voice code (at step S601), and classifies the input signal into a voice section containing voice and a nonvoice section containing no voice (at step S602). Next, the voice classifying unit 41 decides presence or absence of cyclicity, presence or absence of steadiness, and presence or absence of similarity, in the section decided as "voice" (at steps S603 to S605). The voice classifying unit 41 classifies the input signal based on a result of the decision (at step S606). In the present invention, items of classification are not limited to cyclicity, steadiness, and similarity, and other classification items can be also used. Unclassified items do not need to be decided.

Figure 14:
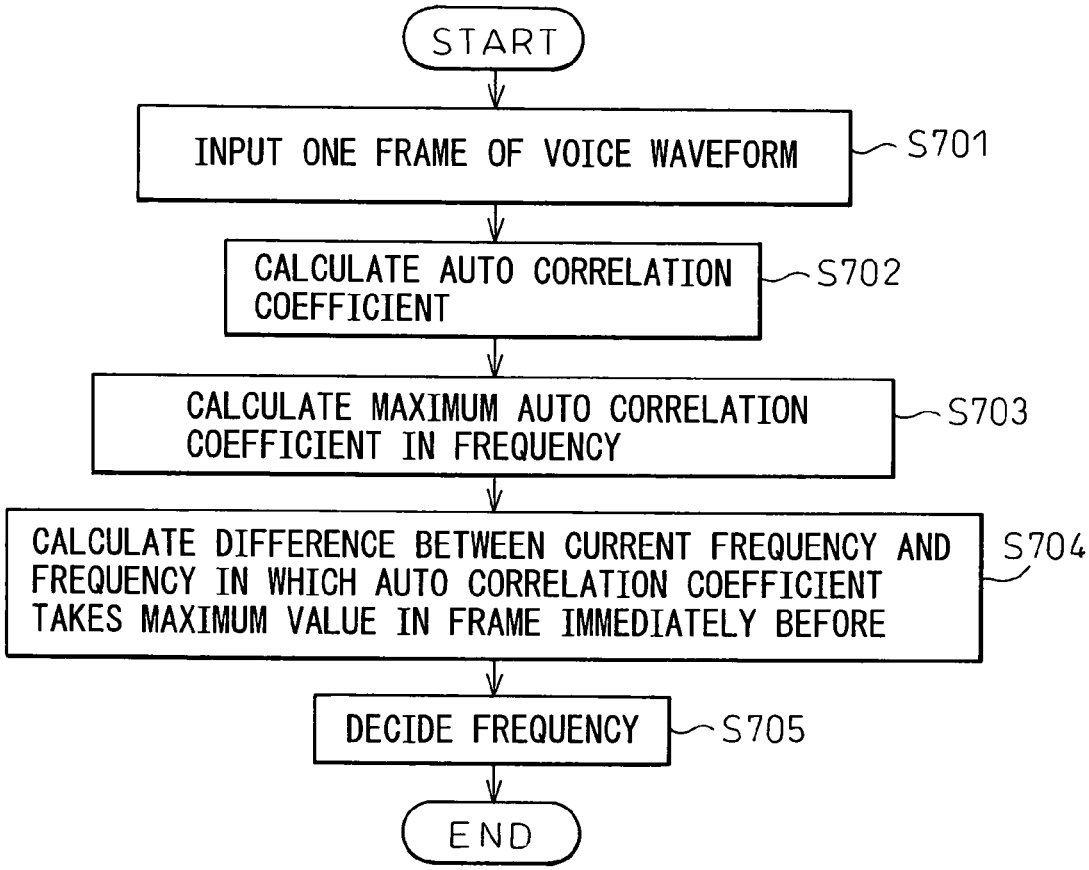
FIG. 14 is a flowchart showing one example of a decision about cyclicity shown in FIG. 13.

FIG. 14 is a flowchart showing one example of a decision about cyclicity (at step S603) shown in FIG. 13.

In the present example, a general method of calculating an auto correlation coefficient is applied to a voice waveform. Input frames are sampled, and a frequency in which the auto correlation coefficient takes a maximum value is calculated (at steps S701 to S703). Cyclicity is decided based on a difference between this frequency and a frequency in which the auto correlation coefficient takes a maximum value in a frame immediately before (at step S704). For example, a predetermined threshold value is compared with the difference. When the difference is equal to or smaller than the threshold value, the section is decided as "cyclical" (at step S705). In other cases, the section is decided as "noncyclical".

Figure 15:
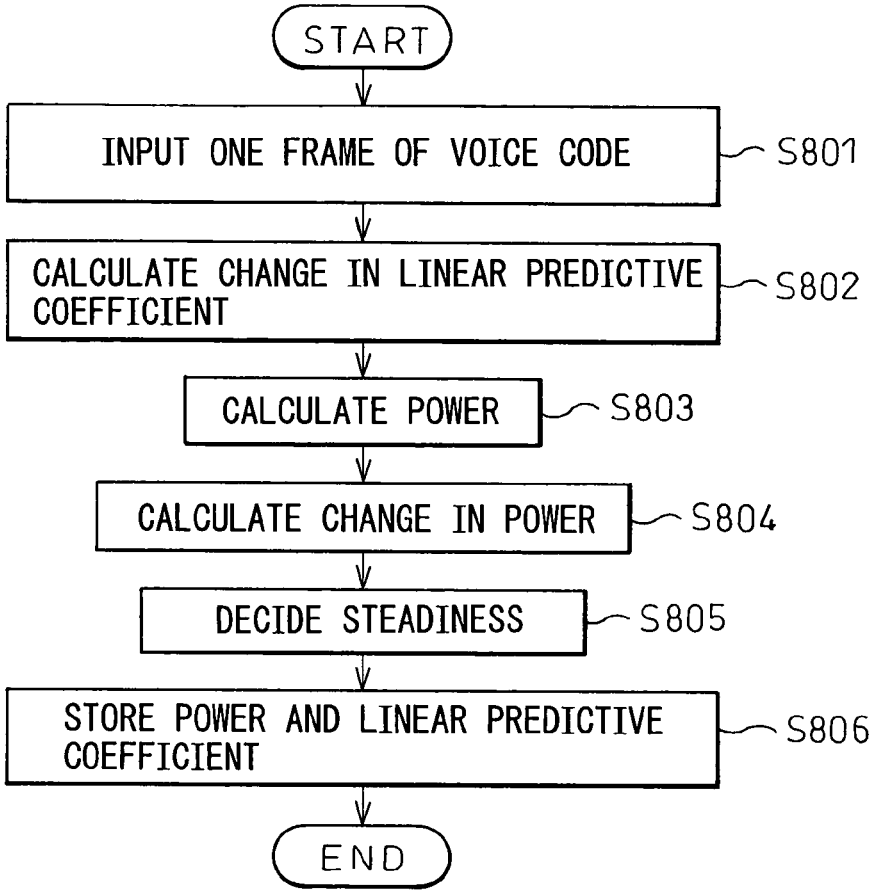
FIG. 15 is a flowchart showing one example of a decision about steadiness shown in FIG. 13.

FIG. 15 is a flowchart showing one example of a decision about steadiness (at step S604) shown in FIG. 13.

In the present example, a voice code is used to calculate power. First, one frame of a voice code is input, and a change (a standard deviation (SD)) of a linear predictive coefficient is calculated (at steps S801 and S802). For this purpose, the SD of linear predicative coefficients is calculated from the following expression (1).

$$SD = \frac{1}{n}\sum_{i=1}^{n}(Ci - Pi)^2 \tag{1}$$

where, n represents order of the analysis of a linear prediction, Ci represents a linear predictive coefficient (i-th order) of the current frame, and Pi represents a linear predictive coefficient (i-th order) of the preceding frame.

Next, power (POW) is calculated from the following expression (2) (at step S803).

$$POW = \frac{1}{m}\sum_{i=1}^{m}A_i^2 \tag{2}$$

where, m represents a number of samples of m frames, and Ai represents amplitude of the current frame (i-th sample).

Next, a change in power (DP) is calculated from the following expression (3) (at step S804).

$$DP = \mathrm{POW}_t - \mathrm{POW}_{t-1} \tag{3}$$

where, $\mathrm{POW}_t$ represents power of the current frame, and $\mathrm{POW}_{t-1}$, represents power of the preceding frame.

Last, steadiness is decided based on a result of the above calculation (at step S805). In the present example, when the SD is equal to or smaller than a predetermined threshold and also when the DP is equal to or smaller than a predetermined threshold value, the section is decided as "steady". In other cases, the section is decided as "unsteady". For deciding the next frame, power and a linear predictive coefficient of the current frame are stored (at step S806).

Figure 16:
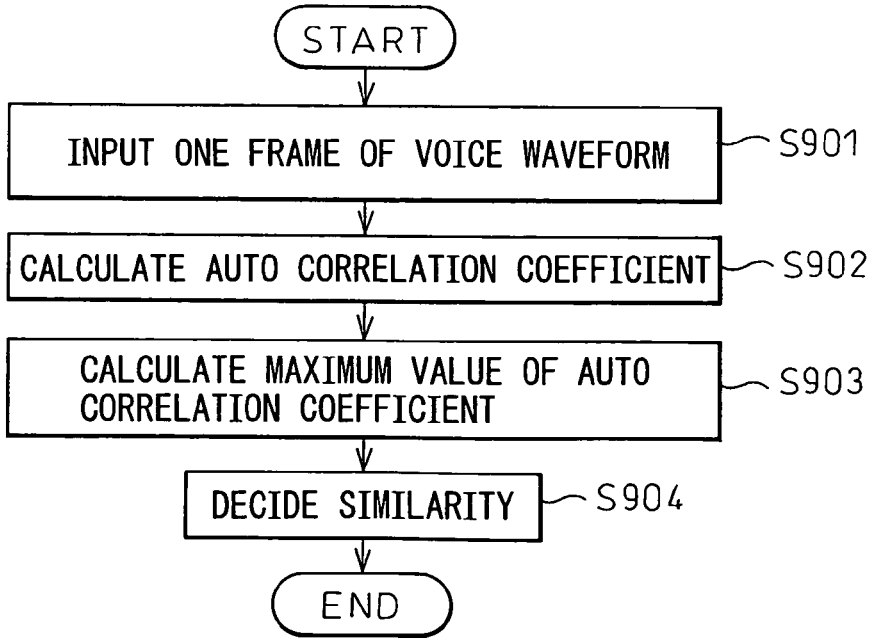
FIG. 16 is a flowchart showing one example of a decision about similarity shown in FIG. 13.

FIG. 16 is a flowchart showing one example of a decision about similarity shown (at step S605) in FIG. 13.

In the present example, the auto correlation coefficient same as that explained with reference to FIG. 14 is used to decide similarity. First, one frame of a voice waveform of an input signal is input (at step S901). Next, an auto correlation coefficient is calculated, and a maximum value of the auto correlation coefficient is calculated (at steps S902 and S903). The maximum value of the auto correlation coefficient is compared with a predetermined threshold value. When the maximum value of the auto correlation coefficient is equal to or larger than the predetermined threshold value, the section is determined as "similar". In other cases, the section is determined as "dissimilar".

Figure 1:
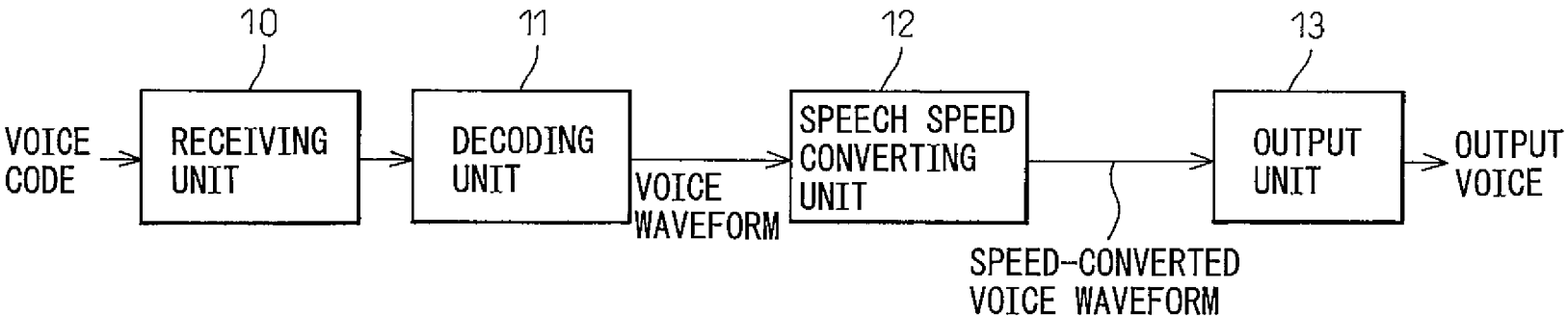
FIG.1 Related Art
FIG. 1 is an explanatory diagram showing an example of application of a speech speed converting device to a voice communication system.
Figure 2:
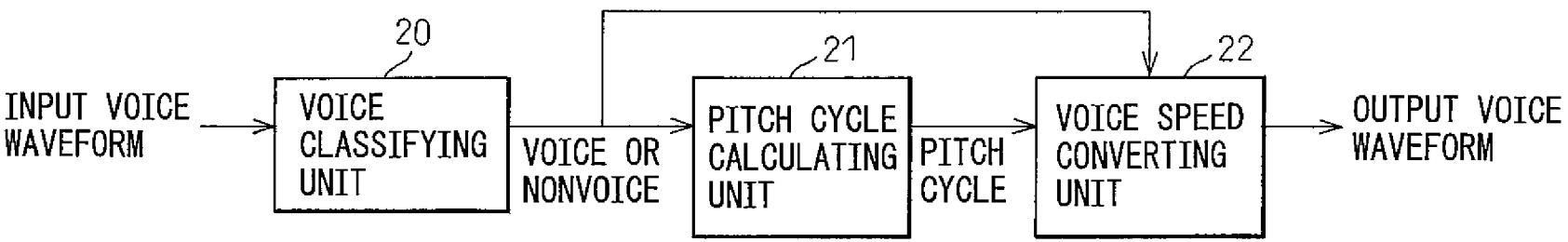
FIG. 2 Related Art
FIG. 2 is an explanatory diagram showing one example of a configuration of a conventional speech speed converting device using a voice waveform.
Figure 3:
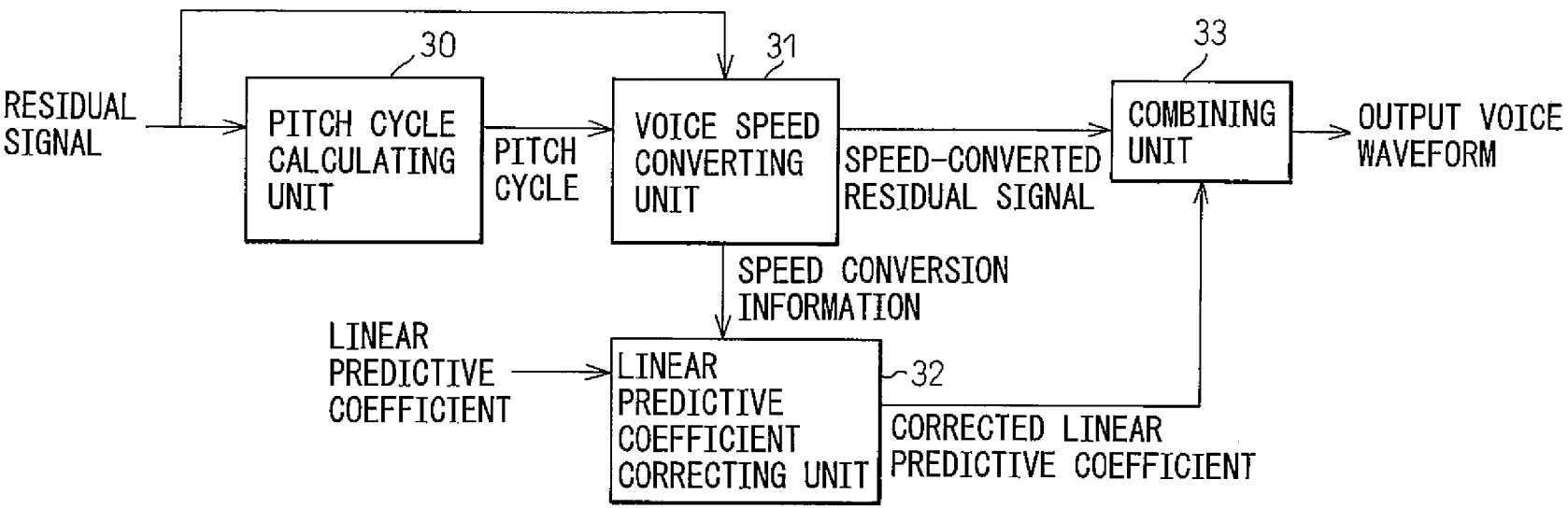
FIG. 3 Related Art
FIG. 3 is an explanatory diagram showing one example of a configuration of a conventional speech speed converting device using a voice code.

A detailed processing of the speed conversion carried out by the speed adjusting unit 42 (at step S503 in FIG. 12) is explained next. A processing carried out using a voice code is explained in the examples shown in FIG. 17 and FIG. 18 (see FIG. 3). Before this processing, the speed adjusting unit 42 selects one of terminal processing in the flow (at steps S406, S407, S408, S411, S412, and S413) shown in FIG. 11 based on a result of classification carried out by the voice classifying unit 41. A processing using a voice waveform is carried out based on an existing method of a TDHS algorithm or the like (see FIG. 2).

Figure 17:
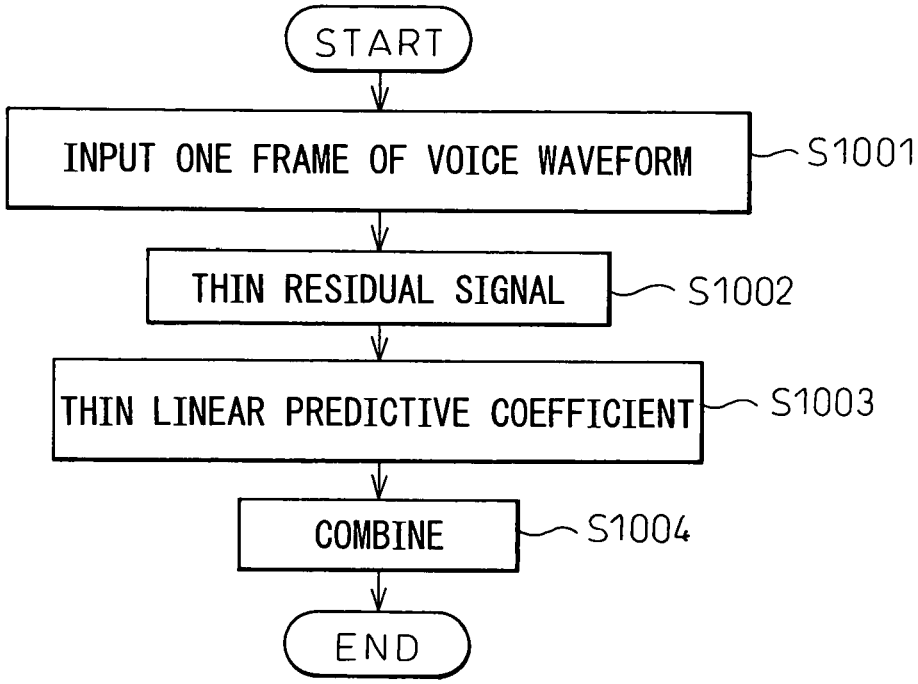
FIG. 17 is a flowchart showing one example of a speed adjustment (at the time of a contraction) using a code.

FIG. 17 is a flowchart showing one example of a speed adjustment (at the time of a contraction) using a code.

In the present example, the speed adjusting unit 42 first inputs one frame of a voice code (at step S1001). Next, from the past one frame and the current frame, a residual signal of the past one frame is thinned. As a result, a residual signal of one frame is generated from the residual signals of the two frames (at step S1002). At the same time, from the past one frame and the current frame, a linear predictive coefficient of the frame immediately before is thinned. As a result, a linear predictive coefficient of one frame is generated from the linear predictive coefficients of the two frames (at step S1003). The generated residual signal of one frame and the generated linear predictive coefficient of one frame are input to the linear predicting filter. Consequently, a voice waveform having an increased speed by contraction is generated by combining (at step S1004).

Figure 18:
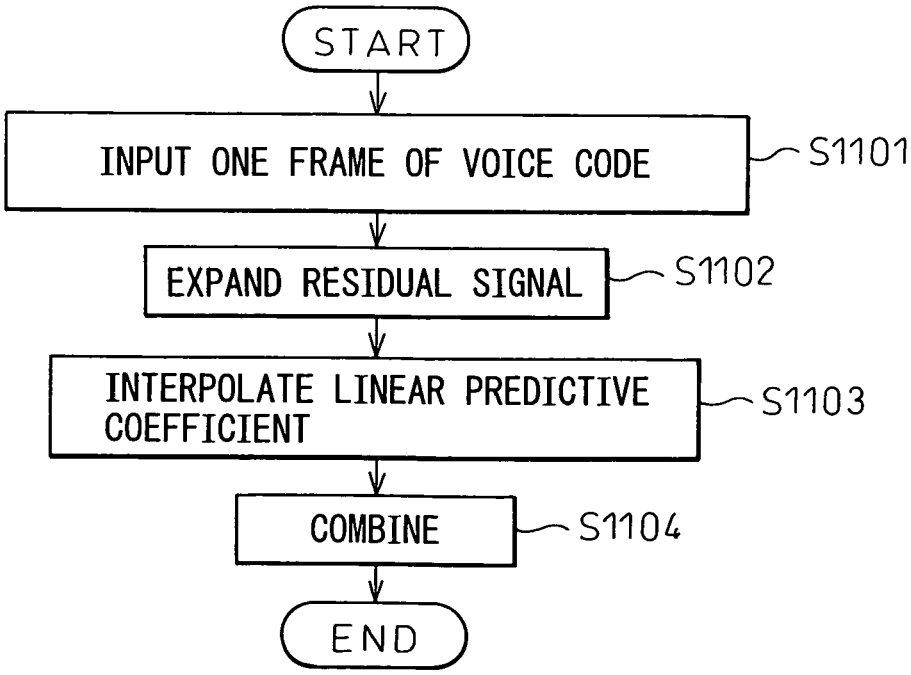
FIG. 18 is a flowchart showing one example of a speed adjustment (at the time of an expansion) using a code.

FIG. 18 is a flowchart showing one example of a speed adjustment (at the time of an expansion) using a code.

In the present example, the speed adjusting unit 42 first inputs one frame of a voice code (at step S1101). In this case, a new residual signal of one frame is generated using the residual signal of the past one frame and the residual signal of the current frame. For this purpose, weight coefficients that add up to one are multiplied to the residual signal of the past one frame and the residual signal of the current frame. The weighted residual signals are added together to generate a new residual signal. The generated residual signal is inserted into between the residual signal of the past one frame and the residual signal of the current frame, thereby generating residuals of three frames (at step S1102). In the case of an encoding system having a codebook, an index of a codebook is generated at random, thereby generating a new residual signal of one frame.

Next, the linear predictive coefficient of the past one frame and the linear predictive coefficient of the current frame are interpolated to generate a new linear predictive coefficient. The generated linear predictive coefficient is inserted between the linear predictive coefficient of the past one frame and the linear predictive coefficient of the current frame, thereby generating linear predictive coefficients of three frames (at step S1103). In the case of an encoding system having a codebook, an index of a codebook is generated at random, thereby generating a new residual signal of one frame. Last, the generated residual signals of the three frames and the generated linear predictive coefficients of the three frames are input to the linear predicting filter. Consequently, a voice waveform having a decreased speed by expansion is generated by combining (at step S11004).

As described above, according to the present invention, because both voice waveform data and a voice code are used, information can be selectively used based on the characteristic of the voice. Quality of the speed-converted voice can be improved, as compared with the quality of voice obtained by speed conversion using only one of the voice waveform data and the voice code. Further, the input signal is classified into several kinds of voice. Based on the classification of voice, the speed of the input signal can be converted by a method using either one of or both the voice waveform data and the voice code, thereby decreasing the degradation in the voice. Quality of the speed-converted a voice can be improved, as compared with the quality of a voice obtained by speed conversion using only one of the voice waveform data and the voice code.

What is claimed is:

1. A speech speed converting device comprising:

a voice classifying unit that is input with an input signal, which includes voice waveform data, and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method, wherein the voice classifying unit classifies the input signal based on steadiness which is determined based on both a magnitude of change of a linear predictive coefficient of the input signal and a magnitude of change of power of the input signal.

2. A speech speed converting device comprising:

a voice classifying unit that is input with an input signal, which includes voice waveform data, and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method, wherein the voice classifying unit classifies the input signal based on both cyclicity which is determined based on a magnitude of change of frequency in which an auto correlation coefficient of the input signal takes a maximum value, and steadiness which is determined based on both a magnitude of change of a linear predictive coefficient of the input signal and a magnitude of change of power of the input signal.

3. A speech speed converting device comprising:

a voice classifying unit that is input with an input signal, which includes voice waveform data, and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method, wherein the voice classifying unit classifies the input signal based on both steadiness which is determined based on both a magnitude of change of the linear predictive coefficient of the input signal and a magnitude of change of power of the input signal and similarity which is determined based on a magnitude of an auto correlation coefficient of the input signal.

4. A speech speed converting device comprising:

a voice classifying unit that is input with an input signal, which includes voice waveform data, and a voice code based on a linear prediction, and that classifies the input signal based on the characteristic of the input signal; and a speed adjusting unit that selects either one of or both a speed conversion processing using the voice waveform and a speed conversion processing using the voice code, based on the classification, and that changes a speech speed of the input signal using the selected speed converting method, wherein the voice classifying unit classifies the input signal based on cyclicity which is determined based on a magnitude of change of a frequency in which an auto correlation coefficient of the input signal takes a maximum value, steadiness which is determined based on both a magnitude of change of a linear predictive coefficient of the input signal and a magnitude of change of power of the input signal, and similarity which is determined based on a magnitude of the auto correlation coefficient of the input signal.

5. A speech speed converting method carried out by a speech speed converting device, comprising:

inputting an input signal, which includes voice waveform data, and a voice code based on a linear prediction;

determining steadiness of the input signal based on a magnitude of change of a linear predictive coefficient of the input signal and a magnitude of change of power of the input signal;

classifying the input signal based on a characteristic of the input signal:

selecting at least one of a speed conversion processing using the voice waveform and a speed conversion processing using the voice code, based on the classification; and changing a speech speed of the input signal using the selected speed converting method; and wherein the classifying classifies the input signal based on the determined steadiness.

6. A speech speed converting method carried out by a speech speed converting device, comprising:

inputting an input signal, which includes voice waveform data, and a voice code based on a linear prediction;

determining cyclicity of the input signal based on a magnitude of change of a frequency in which an autocorrelation coefficient of the input signal has a maximum value;

determining steadiness of the input signal based on a magnitude of change of a linear predictive coefficient of the input signal and a magnitude of change of power of the input signal;

classifying the input signal based on a characteristic of the input signal;

selecting at least one of a speed conversion processing using the voice waveform and a speed conversion processing using the voice code, based on the classification; and changing a speech speed of the input signal using the selected speed converting method; and wherein the classifying classifies the input signal based on both the determined cyclicity and the determined steadiness.

7. A speech speed converting method carried out by a speech speed converting device, comprising:

inputting an input signal, which includes voice waveform data, and a voice code based on a linear prediction;

determining steadiness of the input signal based on both a magnitude of change of a linear predictive coefficient of the input signal and a magnitude of change of power of the input signal;

determining similarity of the input signal based on a magnitude of an auto correlation coefficient of the input signal;

classifying the input signal based on a characteristic of the input signal;

selecting at least one of a speed conversion processing using the voice waveform and a speed conversion processing using the voice code, based on the classification; and changing a speech speed of the input signal using the selected speed converting method; and wherein the classifying classifies the input signal based on both the determined steadiness and the determined similarity.

8. A speech speed converting method carried out by a speech speed converting device, comprising:

inputting an input signal, which includes voice waveform data, and a voice code based on a linear prediction;

determining cyclicity of the input signal based on a magnitude of change of a frequency in which an auto correlation coefficient of the input signal has a maximum value;

determining steadiness of the input signal based on a magnitude of change of a linear predictive coefficient of the input signal and a magnitude of change of power of the input signal;

determining similarity of the input signal based on a magnitude of the auto correlation coefficient of the input signal;

classifying the input signal based on a characteristic of the input signal;

selecting at least one of a speed conversion Processing using the voice waveform and a speed conversion Processing using the voice code, based on the classification; and changing a speech speed of the input signal using the selected speed converting method; and wherein the classifying classifies the input signal based on the determined cyclicity, the determined steadiness, and the determined similarity.

* * * * *